US012108901B2

(12) United States Patent
Liu

(10) Patent No.: US 12,108,901 B2
(45) Date of Patent: Oct. 8, 2024

(54) INTERNAL LOCKING RETRACTABLE SHOWER CURTAIN ROD AND CONNECTOR

(71) Applicant: Dongguan Shenghong Household Items Co., Ltd, Guangdong (CN)

(72) Inventor: Huisheng Liu, Dongguan (CN)

(73) Assignee: Dongguan Shenghong Household Items Co., Ltd., Dongguan (CN)

( * ) Notice: Subject to any disclaimer, the term of this patent is extended or adjusted under 35 U.S.C. 154(b) by 0 days.

(21) Appl. No.: 17/550,760

(22) Filed: Dec. 14, 2021

(65) Prior Publication Data

US 2023/0180957 A1 Jun. 15, 2023

(51) Int. Cl.
*A47H 1/022* (2006.01)
*A47K 3/38* (2006.01)

(52) U.S. Cl.
CPC ..... *A47H 1/022* (2013.01); *A47K 3/38* (2013.01)

(58) Field of Classification Search
CPC ..... A47H 1/022; A47H 1/02; A47H 1/102; A47H 2001/0215; A47K 3/38
See application file for complete search history.

(56) References Cited

U.S. PATENT DOCUMENTS 2,494,878 A * 1/1950 Jensen ..... A63C 11/221 403/109.5
2,508,039 A * 5/1950 Neuwirth ..... F16B 7/1463 248/188.5
3,004,743 A * 10/1961 Wenger ..... F16B 7/1463 248/161
3,098,669 A * 7/1963 Fortin ..... B25G 1/04 248/188.5
3,560,032 A * 2/1971 Cohen et al. ..... F16B 7/1463 403/104
4,134,703 A * 1/1979 Hinners ..... A63C 11/221 248/188.5
4,856,929 A * 8/1989 Smahlik ..... A47L 1/06 248/161
4,895,471 A * 1/1990 Geltz ..... F16B 7/14 403/109.8
5,826,847 A * 10/1998 Warner ..... F16B 7/1463 248/200.1
6,250,839 B1 * 6/2001 Lenhart ..... A63C 11/221 403/109.5
6,862,776 B2 * 3/2005 Chen ..... F16B 7/1463 403/109.5
8,215,863 B2 * 7/2012 Sohn ..... F16B 7/1463 403/109.5

(Continued)

*Primary Examiner* — Stanton L Krycinski

(57) ABSTRACT

The present invention relates to the technical field of shower curtain rods, in particular to an internal locking retractable shower curtain rod and an internal locking retractable connector. An internal locking retractable shower curtain rod, wherein it comprises a thick tube, a thin tube and an internal locking retractable connector. The first connecting piece is arranged at one end of the thin tube. The second connecting piece is arranged in the thick tube. One end of the thin tube where the first connecting piece extends into the thick tube. The present application provides an internal locking retractable shower curtain rod which can adapt to changes in bathroom space to a certain extent, and has technical advantages such as good adaptability, simple installation, and wall protection.

10 Claims, 5 Drawing Sheets

(56) References Cited

U.S. PATENT DOCUMENTS 8,297,870 B2 * 10/2012 Lenhart ..... A63C 11/221 403/109.5
8,479,932 B2 * 7/2013 Carney ..... A47H 1/022 403/109.5
8,500,357 B2 * 8/2013 Stahle ..... F16B 7/1463 403/374.4
8,827,587 B2 * 9/2014 Didehvar ..... A47H 1/022 248/265
8,851,305 B2 * 10/2014 Didehvar ..... F16B 7/06 248/354.3
8,851,435 B1 * 10/2014 Bastien ..... A47H 1/022 248/200.1
8,960,456 B2 * 2/2015 Didehvar ..... F16B 7/1463 403/109.5
9,388,837 B1 * 7/2016 Hanley ..... F16B 7/1463
9,480,314 B2 * 11/2016 Heim ..... A45B 9/00
10,047,787 B2 * 8/2018 Cheng ..... F16B 7/182
10,070,748 B2 * 9/2018 Hanley ..... A47H 1/022
10,426,287 B1 * 10/2019 Tsai ..... A47H 1/022
10,478,019 B2 * 11/2019 Pegden ..... A47H 1/102
10,844,890 B2 * 11/2020 Daniels ..... F16B 7/1445
10,959,559 B2 * 3/2021 Moss ..... A47H 1/102
10,995,786 B2 * 5/2021 Didehvar ..... F16B 7/025
11,141,016 B2 * 10/2021 Chuang ..... A47H 1/022
11,382,447 B2 * 7/2022 Berman ..... A47H 1/022
2006/0204322 A1 * 9/2006 Roiser ..... F16B 7/1463 403/109.5
2010/0310306 A1 * 12/2010 Wright ..... B25G 1/04 403/109.1
2012/0152874 A1 * 6/2012 Didehvar ..... A47K 3/38 211/105.4
2012/0284914 A1 * 11/2012 Bauer ..... A47K 3/38 4/610
2013/0112639 A1 * 5/2013 Baines ..... A47K 3/38 211/123
2014/0263123 A1 * 9/2014 Ford ..... A47H 1/022 211/105.4
2016/0177991 A1 * 6/2016 Daniels ..... A47H 1/022 403/109.1
2016/0206126 A1 * 7/2016 Ford ..... A47K 3/38
2020/0245801 A1 * 8/2020 Hsu ..... A47H 1/022
2022/0160158 A1 * 5/2022 Scanlon ..... A47H 1/102

* cited by examiner

INTERNAL LOCKING RETRACTABLE SHOWER CURTAIN ROD AND CONNECTOR

FIELD OF THE INVENTION

The present invention relates to the technical field of shower curtain rods, in particular to an internal locking retractable shower curtain rod and an internal locking retractable connector.

BACKGROUND

Shower curtain rods are special wares installed in bathrooms for hanging objects. There are two technical problems in existing shower curtain rods: 1. Holes need to be drilled on the wall during installation, which may damage the wall and affect the appearance of bathroom after removal; 2. Delivered shower curtain rods have a fixed length and cannot adapt to changes in bathroom space.

SUMMARY

In view of this, the present invention provides an internal locking retractable shower curtain rod and an internal locking retractable connector to solve the technical problems existing in the prior art.

The internal locking retractable connector provided by the present invention to solve the technical problems is: an internal locking retractable connector, wherein it comprises the first connecting piece and the second connecting piece. The first connecting piece comprises a fixed part and a screw part which is integrally connected to the fixed part. The second connecting piece comprises a threaded core and a tensioning piece. The threaded core comprises an internal thread part and a clearance. The tensioning piece comprises a tensioning sleeve with an open-ring structure. A wedge-shaped structure is arranged in the tensioning sleeve. The tensioning piece is wrapped around the outside of the threaded core through the tensioning sleeve and the wedge-shaped structure extends into the clearance. The screw part of the first connecting piece is arranged in the threaded core of the second connecting piece and connected to the internal thread part of the threaded core through thread. When the screw part of the first connecting piece gradually rotates and retracts from the threaded core, it can press the wedge-shaped structure to make the tensioning sleeve expand outward and deform.

Preferably, the number of clearances and the number of wedge-shaped structures are both two. Preferably, the tensioning piece is made of plastic.

Preferably, the screw part has a straight screw structure.

Preferably, the first connecting piece is provided with a retracting part, and the retracting part is arranged between the fixed part and the screw part. The wedge-shaped structure comprises a wedge-shaped section and a horizontal section. When the screw part retracts from the threaded core, the retracting part holds the horizontal section of the wedge-shaped structure. In addition, when the first connecting piece is assembled with the second connecting piece, the retracting part also holds the horizontal section of the wedge-shaped structure.

Preferably, the first connecting piece is provided with a tightening part, and the tightening part is arranged between the fixed part and the screw part. When the screw part retracts from the threaded core, the tightening part can gradually press the wedge-shaped structure which makes the tensioning sleeve continuously expand outward and deform.

Further preferably, the slopes of the tightening part and the wedge-shaped structure match with each other.

The internal locking retractable shower curtain rod provided by the present invention to solve the technical problems is:

An internal locking retractable shower curtain rod, wherein it comprises a thick tube, a thin tube and an internal locking retractable connector described in any of the foregoing technical schemes. The first connecting piece is arranged at one end of the thin tube. The second connecting piece is arranged in the thick tube. One end of the thin tube where the first connecting piece extends into the thick tube.

Preferably, the fixed part of the first connecting piece is fastened to the end of the thin tube by interference fit and/or riveted connection and/or screwed connection.

Preferably, the tensioning piece of the second connecting piece is fixed in the thick tube by locking structure and/or interference fit and/or riveted connection and/or screwed connection. When relative rotation occurs between the thick tube and the thin tube, the tensioning piece can maintain connection with the thick tube and move together.

Beneficial Technical Effects

1. The present application provides an internal locking retractable connector and an internal locking retractable shower curtain rod which can adapt to changes in bathroom space to a certain extent, and have technical advantages such as good adaptability, simple installation, and wall protection. When disassembly is required, rotate the thick tube and the thin tube in opposite directions. The internal locking retractable connector restores to its original state, the horizontal section of the wedge-shaped structure returns to the retracting part, and the shower curtain rod gets longer. At this time, the equipment can be disassembled and repaired freely.

2. As the shower curtain rod keeps getting longer, when the tightening part of the first connecting piece passes through the wedge-shaped structure of the second connecting piece, the pressing force of the first connecting piece on the wedge-shaped structure of the second connecting piece does not increase any more, then the connection strength and stability between the first connecting piece and the second connecting piece are the highest. Due to the use of straight screw structure, the first connecting piece can retract from the threaded core at this time, that is, the shower curtain rod can get longer until it is fastened to the desired wall.

The technical schemes and technical effects of the present invention will be described in detail below with reference to the drawings and preferred embodiments.

DESCRIPTION OF THE REFERENCE NUMERALS

10—First connecting piece, 20—Second connecting piece, 30—Thick tube, 40—Thin tube;

110—Fixed part, 120—Screw part, 130—Retracting part, 140—Tightening part;
210—Threaded core, 220—Tensioning piece;
2110—Internal thread part, 2120—Clearance;
2210—Tensioning sleeve, 2220—Wedge-shaped structure;
2221—Wedge-shaped section, 2222—Horizontal section.

DETAILED DESCRIPTION

Figure 1:
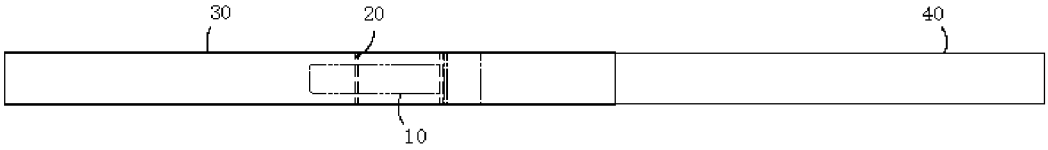
FIG. 1: A perspective view of the internal locking retractable shower curtain rod.
Figure 2:
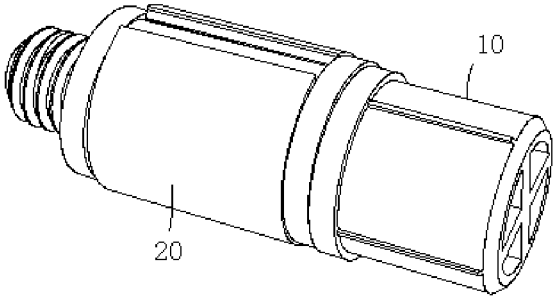
FIG. 2: An assembly diagram of the internal locking retractable connector.
Figure 3:
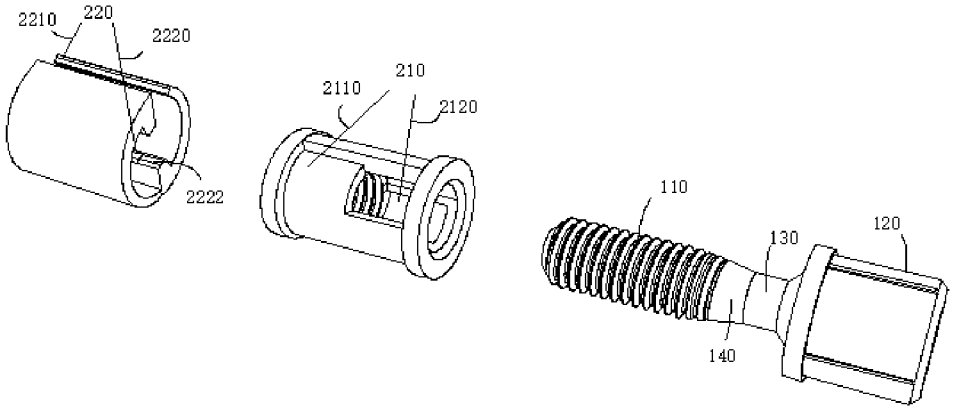
FIG. 3: An exploded view of the internal locking retractable connector.
Figure 4:
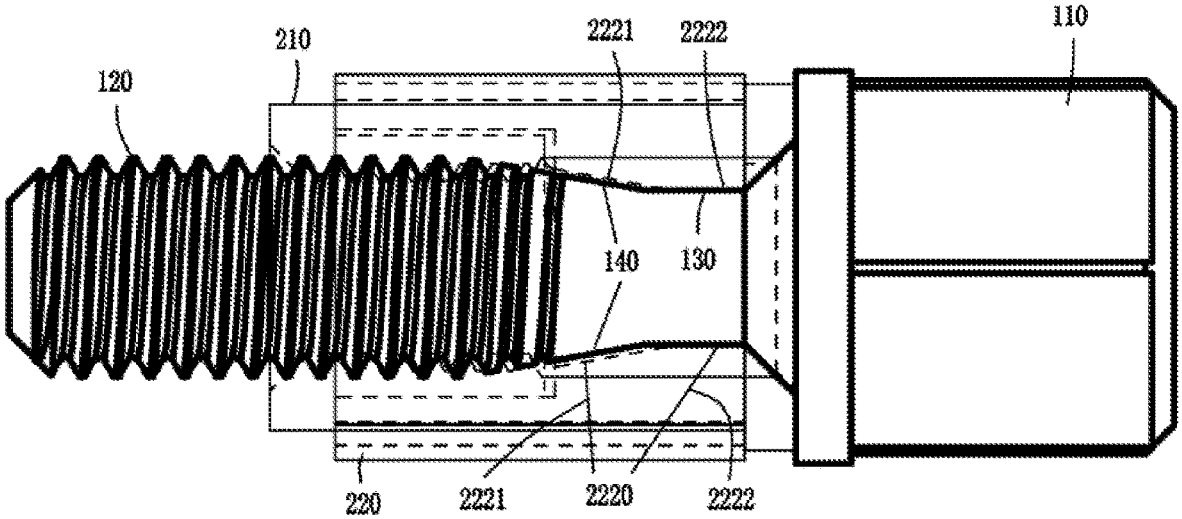
FIG. 4: A perspective view of the internal locking retractable connector.

As shown in FIGS. 1-2, the present invention provides an internal locking retractable shower curtain rod, comprising a thick tube 30, a thin tube 40 and an internal locking retractable connector. One end of the thin tube 40 is arranged in the thick tube 30 through the internal locking retractable connector. When relative rotation occurs between the thick tube 30 and the thin tube 40, the thin tube 40 can gradually retract from the thick tube 30, so that the overall length of the shower curtain rod becomes larger, and at the same time, the internal locking retractable connector can continuously tighten the connection between the thick tube 30 and the thin tube 40 to ensure high mechanical strength and connection reliability of the internal locking retractable shower curtain rod.

When the thick tube 30 and the thin tube 40 rotate in opposite directions, the thin tube 40 can be gradually screwed into the thick tube 30 and restore.

As shown in FIGS. 1-5, the present application provides an internal locking retractable connector which can connect the thick tube 30 to the thin tube 40, comprising the first connecting piece 10 and the second connecting piece 20.

The first connecting piece 10 comprises a fixed part 110 and a screw part 120 which is integrally connected to the fixed part 110. The first connecting piece 10 is provided with a retracting part 130 and a tightening part 140. The screw part 120 has a straight screw structure. The retracting part 130 is arranged between the fixed part 110 and the screw part 120, which is actually a groove structure machined on the first connecting piece 10. When the screw part 120 retracts from the threaded core 210, the retracting part 130 holds the horizontal section 2222 of the wedge-shaped structure 2220. In addition, when a connection is established between the first connecting piece 10 and the second connecting piece 20, i.e. assembly, the retracting part 130 holds the highest point of the wedge-shaped structure 2220. The tightening part 140 is arranged between the fixed part 110 and the screw part 120, which is actually a slope structure whose slope matches with that of the wedge-shaped structure 2220. When the screw part 120 retracts from the threaded core 210, the tightening part 140 can gradually press the wedge-shaped section 2221 of the wedge-shaped structure 2220 so that the wedge-shaped structure 2220 can make the tensioning sleeve 2210 continuously expand outward and deform.

The second connecting piece 20 comprises a threaded core 210 and a tensioning piece 220. The threaded core 210 comprises an internal thread part 2110 and a clearance 2120. The tensioning piece 220 comprises a tensioning sleeve 2210 with an open-ring structure. A wedge-shaped structure 2220 is arranged in the tensioning sleeve 2210. The tensioning piece 220 is wrapped around the outside of the threaded core 210 through the tensioning sleeve 2210, and the wedge-shaped structure 2220 extends into the clearance 2120.

The wedge-shaped structure 2220 comprises a wedge-shaped section 2221 and a horizontal section 2222. When the screw part 120 retracts from the threaded core 210, the retracting part 130 holds the horizontal section 2222 of the wedge-shaped structure 2220. When the first connecting piece 10 is assembled with the second connecting piece 20, the retracting part 130 holds the horizontal section 2222 of the wedge-shaped structure 2220. The number of clearances 2120 and the number of wedge-shaped structures 2220 are both two. The tensioning piece 220 is made of plastic.

After the first connecting piece 10 is assembled with the second connecting piece 20, the screw part 120 of the first connecting piece 10 is arranged in the threaded core 210 of the second connecting piece 20 and connected to the internal thread part 2110 of the threaded core 210 through thread. The tightening part 140 of the first connecting piece 10 tightly fits the wedge-shaped section 2221 of the wedge-shaped structure 2220 in the tensioning sleeve 2210, and the horizontal section 2222 of the wedge-shaped structure 2220 on the second connecting piece 20 is in the retracting part 130.

When the screw part 120 of the first connecting piece 10 gradually rotates and retracts from the threaded core 210, the tightening part 140 presses the wedge-shaped section 2221 of the wedge-shaped structure 2220 to make the tensioning sleeve 2210 continuously expand outward and deform.

The wedge-shaped section 2221 of the wedge-shaped structure 2220 is a slope structure with a certain inclination. The wedge-shaped section 2221 gradually gets higher towards the fixed part 110 and smoothly transitions to the horizontal section 2222. When the screw part 120 gradually rotates and retracts from the internal thread part 2110, the pressing force of the tightening part 140 on the wedge-shaped structure 2220 gets greater, and the deformation of the tensioning sleeve 2210 gets worse, so that the connection strength and reliability between the first connecting piece 10 and the second connecting piece 20 get higher, and the shower curtain rod gets longer.

When the screw part 120 of the first connecting piece 10 rotates in the opposite direction and gradually enters and completely or partially passes through the threaded core 210, the internal locking retractable connector restores, and at this time, the horizontal section 2222 of the wedge-shaped structure 2220 is in the retracting part 130.

The first connecting piece 10 is arranged at one end of the thin tube 40, the second connecting piece 20 is arranged in the thick tube 30, and the end of the thin tube 40 where the first connecting piece 10 extends into the thick tube 30. Specifically, the fixed part 110 of the first connecting piece 10 is fastened to the end of the thin tube 40 by interference fit and/or riveted connection and/or screwed connection. The tensioning piece 220 of the second connecting piece 20 is fixed in the thick tube 30 by locking structure and/or interference fit and/or riveted connection and/or screwed connection. When relative rotation occurs between the thick tube 30 and the thin tube 40, the tensioning piece 220 can maintain connection with the thick tube 30 dynamically or statically, that is, when the first connecting piece 10 rotates, the tensioning piece 220 cannot rotate with the first connecting piece 10.

Description of the Principle:

1. The present application provides an internal locking retractable shower curtain rod, which can adapt to changes in bathroom space to a certain extent. The shower curtain rod placed in a suitable position can automatically get longer when the thick tube 30 and the thin tube 40 rotate so as to hold itself firmly on the wall of the bathroom. Thus, the internal locking retractable shower curtain rod provided herein have technical advantages such as good adaptability, simple installation, and wall protection. When disassembly is required, rotate the thick tube 30 and the thin tube 40 in opposite directions. The internal locking retractable connector restores to its original state, the horizontal section 2222 of the wedge-shaped structure 2220 returns to the retracting part 130, and the shower curtain rod gets shorter. At this time, the equipment can be disassembled and repaired freely.

Figure 5:
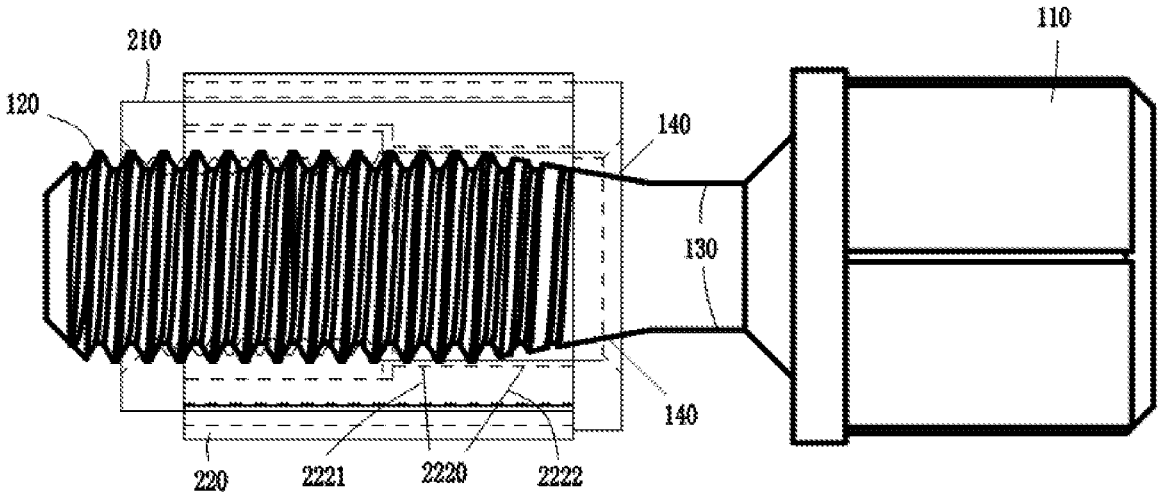
FIG. 5: A perspective view of the internal locking retractable connector being screwed out.

2. FIG. 5 shows that, as the shower curtain rod keeps getting longer, when the tightening part 140 of the first connecting piece 10 passes through the wedge-shaped structure 2220 of the second connecting piece 20, the pressing force of the first connecting piece 10 on the wedge-shaped structure 2220 of the second connecting piece 20 does not increase any more, then the connection strength and stability between the first connecting piece 10 and the second connecting piece 20 are the highest. However, due to the use of straight screw structure, the first connecting piece 10 can retract from the threaded core 210 at this time, that is, the shower curtain rod can get longer until it is fastened to the desired wall.

It should be noted that the ordinal numbers (such as first and second) used in the present application to name related components or structures are only to distinguish similar components or structures with the same composition or functions, and do not imply priorities in the functions or composition of related components or structures or differences in their importance, and should not be construed as limiting the present application.

The technical schemes and technical effects of the present invention are described in detail above with reference to the drawings and specific embodiments. It should be noted that the specific embodiments disclosed in the specification are only preferred embodiments of the present invention, and those skilled in the art can also develop other embodiments on this basis. Any simple deformations and equivalent replacements without departing from the innovative concept of the present invention are covered by and fall within the protection scope of the present invention.

I claim:

1. An internal locking retractable connector, wherein the connector comprises a first connecting piece (10) and a second connecting piece (20); the first connecting piece (10) comprises a fixed part (110) and a screw part (120) which is integrally connected to the fixed part (110); the second connecting piece (20) comprises a threaded core (210) and a tensioning piece (220), the threaded core (210) comprises an internal thread part (2110) and a clearance (2120), the tensioning piece (220) comprises a tensioning sleeve (2210) with an open-ring structure, a wedge-shaped structure (2220) is arranged in the tensioning sleeve (2210), the tensioning piece (220) is wrapped around the outside of the threaded core (210) through the tensioning sleeve (2210) and the wedge-shaped structure (2220) extends into the clearance (2120); the screw part (120) of the first connecting piece (10) is arranged in the threaded core (210) of the second connecting piece (20) and connected to the internal thread part (2110) of the threaded core (210) through thread, when the screw part (120) of the first connecting piece (10) gradually rotates and retracts from the threaded core (210), the screw part can press the wedge-shaped structure (2220) to make the tensioning sleeve (2210) expand outward and deform.

2. The internal locking retractable connector according to claim 1, wherein the number of the clearance (2120) and the number of the wedge-shaped structure (2220) are both two.

3. The internal locking retractable connector according to claim 1, wherein the tensioning piece (220) is made of plastic.

4. The internal locking retractable connector according to claim 1, wherein the screw part (120) has a straight screw structure.

5. The internal locking retractable connector according to claim 1, wherein the first connecting piece (10) is provided with a retracting part (130), and the retracting part (130) is arranged between the fixed part (110) and the screw part (120); the wedge-shaped structure (2220) comprises a wedge-shaped section (2221) and a horizontal section (2222); when the screw part (120) retracts from the threaded core (210), the retracting part (130) holds the horizontal section (2222) of the wedge-shaped structure (2220).

6. The internal locking retractable connector according to claim 1, wherein the first connecting piece (10) is provided with a tightening part (140), and the tightening part (140) is arranged between the fixed part (110) and the screw part (120); when the screw part (120) retracts from the threaded core (210), the tightening part (140) can gradually press the wedge-shaped structure (2220) which makes the tensioning sleeve (2210) continuously expand outward and deform.

7. The internal locking retractable connector according to claim 6, wherein slopes of the tightening part (140) and the wedge-shaped structure (2220) match with each other.

8. An internal locking retractable shower curtain rod comprising the internal locking retractable connector according to claim 1, wherein the rod comprises a thick tube (30), a thin tube (40) and an internal locking retractable connector with the first connecting piece (10) is arranged at one end of the thin tube (40), the second connecting piece (20) is arranged in the thick tube (30), one end of the thin tube (40) where the first connecting piece (10) extends into the thick tube (30).

9. The internal locking retractable shower curtain rod according to claim 8, wherein the fixed part (110) of the first connecting piece (10) is fastened to the end of the thin tube (40) by interference fit and/or riveted connection and/or screwed connection.

10. The internal locking retractable shower curtain rod according to claim 8, wherein the tensioning piece (220) of the second connecting piece (20) is fixed in the thick tube (30) by locking structure and/or interference fit and/or riveted connection and/or screwed connection; when relative rotation occurs between the thick tube (30) and the thin tube (40), the tensioning piece (220) can maintain connection with the thick tube (30) and move together.

* * * * *